US009650811B2

(12) United States Patent
Spinney et al.

(10) Patent No.: US 9,650,811 B2
(45) Date of Patent: May 16, 2017

(54) LOCKING MECHANISM FOR A METER BOX

(71) Applicants: Stephen Spinney, Oxford, MA (US); John Mahaney, Spencer, MA (US)

(72) Inventors: Stephen Spinney, Oxford, MA (US); John Mahaney, Spencer, MA (US)

(73) Assignee: INNER-TITE CORP., Holden, MA (US)

( * ) Notice: Subject to any disclaimer, the term of this patent is extended or adjusted under 35 U.S.C. 154(b) by 275 days.

(21) Appl. No.: 14/508,455

(22) Filed: Oct. 7, 2014

(65) Prior Publication Data

US 2015/0096336 A1 Apr. 9, 2015

Related U.S. Application Data

(60) Provisional application No. 61/887,525, filed on Oct. 7, 2013.

(51) Int. Cl.
*E05B 65/52* (2006.01)
*E05B 65/00* (2006.01)

(52) U.S. Cl.
CPC ..... *E05B 65/0089* (2013.01); *Y10T 70/554* (2015.04); *Y10T 70/5544* (2015.04); *Y10T 70/5566* (2015.04)

(58) Field of Classification Search
CPC ..... E05B 65/0089; Y10T 70/554; Y10T 70/5544; Y10T 70/5562; Y10T 70/5566; Y10T 70/443; Y10T 70/30; Y10T 70/7655; Y10T 70/8541; Y10T 292/68; Y10T 292/705; Y10T 292/707; Y10T 292/31; Y10T 292/314; Y10T 292/319
USPC ..... 70/2, 6–13, 34, 158–173, 386, 370, 371, 70/451, 466; 292/281, 283, 284, 292/DIG. 53, 340, 341.18, 341.19; 248/551–553
See application file for complete search history.

(56) References Cited

U.S. PATENT DOCUMENTS

| | | | | |
|---|---|---|---|---|
| 4,414,829 | A | 11/1983 | Nielsen, Jr. et al. | |
| 5,007,258 | A | 4/1991 | Mahaney | |
| 5,315,849 | A | 5/1994 | Georgopoulos | |
| 5,927,111 | A * | 7/1999 | Nachbauer | F16K 35/10 137/382 |
| 6,742,365 | B1 | 6/2004 | Sullivan et al. | |
| 6,763,691 | B1 | 7/2004 | Rafferty | |
| 6,931,893 | B2 | 8/2005 | Agbay | |
| 7,021,090 | B1 | 4/2006 | Nolle et al. | |
| 7,448,235 | B2 | 11/2008 | Ely et al. | |
| 7,946,143 | B2 | 5/2011 | Rafferty et al. | |
| 8,382,171 | B2 * | 2/2013 | Williams | E05B 15/024 292/1 |

(Continued)

*Primary Examiner* — Lloyd Gall
(74) *Attorney, Agent, or Firm* — Grogan, Tuccillo & Vanderleeden, LLP

(57) ABSTRACT

A locking mechanism includes a bracket configured for mounting on a wall of a securable box and receiving a lock body to selectively secure a cover to the securable box preventing access to an interior of the box. The mechanism further includes a blade that is movable relative to the bracket between a locked position and an unlocked position to secure or remove the blade and bracket to or from a securable box wall respectively. The blade and bracket can be secured to and removed from the securable box without an operator's hand extending into the interior of the box.

17 Claims, 13 Drawing Sheets

(56) References Cited

U.S. PATENT DOCUMENTS

| | | | | |
|---|---|---|---|---|
| 8,733,807 | B2 * | 5/2014 | Williams | E05B 15/024 292/340 |
| 2004/0093917 | A1 * | 5/2004 | Sullivan | E05B 65/0089 70/164 |
| 2005/0044907 | A1 * | 3/2005 | Agbay | E05B 65/0089 70/164 |
| 2005/0178174 | A1 * | 8/2005 | Ely | E05B 65/006 70/164 |
| 2009/0158788 | A1 * | 6/2009 | Rafferty | E05B 65/0089 70/77 |
| 2013/0212864 | A1 | 8/2013 | Stachowiak, Jr. | |

* cited by examiner

LOCKING MECHANISM FOR A METER BOX

CROSS-REFERENCE TO RELATED APPLICATION

This application is related to provisional patent application Ser. No. 61/887,525, filed on Oct. 7, 2013, which is hereby incorporated by reference in its entirety.

FIELD OF THE INVENTION

The present invention relates generally locking mechanisms, and more particularly to a locking mechanism for securing a meter box via a device mounted on a surface of the meter box.

BACKGROUND OF THE INVENTION

Utility boxes, such as electric meter boxes, are typically secured to prevent unauthorized access to the meter. Some boxes feature an electric meter that is secured via the use of a ring style locking device. Other utility boxes, referred to as "ringless" boxes, do not include a lockable meter ring. Ringless boxes are secured by placing a lock on either a top, side wall or a bottom wall of the box.

Many known locking mechanisms for ringless-boxes present potential installation and removal difficulties. For example, known mechanisms are often relatively complex and often require a degree of dexterity that may be challenging for some utility workers, particularly those with reduced or impaired grasping ability. Other mechanisms may require a utility worker to reach into or move toward the interior of a live meter box to remove or install the lock.

With the foregoing concerns in mind, it is the general object of the present invention to provide a locking mechanism for a ringless meter box that provides an improved ease of installation while effectively protecting a meter from unauthorized access.

SUMMARY OF THE INVENTION

In an embodiment, a locking mechanism includes a bracket configured for mounting on a wall of a securable box and receiving a lock body to selectively secure a cover to the securable box preventing access to an interior of the box. The mechanism further includes a blade that is movable relative to the bracket between a locked position and an unlocked position to secure or remove the blade and bracket to or from a securable box wall respectively. The blade and bracket can be secured to and removed from the securable box without an operator's hand extending into the interior of the box.

In an embodiment, a lock assembly includes a lock, a lock body configured to receive the lock, a bracket configured for mounting on a wall of a securable box and receiving the lock body and lock to selectively secure a cover to the securable box preventing access to an interior of the box. The assembly further includes a blade that is movable relative to the bracket between a locked position and an unlocked position to secure or remove the blade and bracket to or from a securable box wall respectively and a pin that is secured to the blade and travels in a slot in the bracket to move the blade between the locked and unlocked positions. The blade and bracket can be secured to and removed from the securable box without an operator's hand extending into the interior of the box.

In another embodiment, a method of preventing access to an interior of a securable box includes placing a bracket on a wall of a securable box, moving a blade located relative to the bracket into a locked position to secure the blade and bracket to the securable box wall and placing a cover on the securable box. The method further includes securing a lock body onto the bracket. The method of preventing access does not require an operator to reach into the interior of the securable box.

In an embodiment, a method of removing a lock assembly from a securable box includes removing a lock body from a bracket that is secured to a wall of a securable box and then removing a cover from the securable box. The method further includes moving a blade located relative to the bracket into an unlocked position to remove blade and bracket to the box wall. The method of removing the lock assembly does not require an operator to reach into the interior of the box.

In yet another embodiment, a locking mechanism includes a bracket configured for mounting on a surface of a securable box and configured to receive a lock body to secure the box, and a blade that is movable in conjunction with the bracket. The blade can be moved between a secured position, in which the bracket and blade are secured to the box, and an unsecured position, in which the bracket and blade may be removed from the surface through the use of an industry standard barrel lock or similarly shaped object.

DETAILED DESCRIPTION OF THE PREFERRED EMBODIMENT

Figure 1:
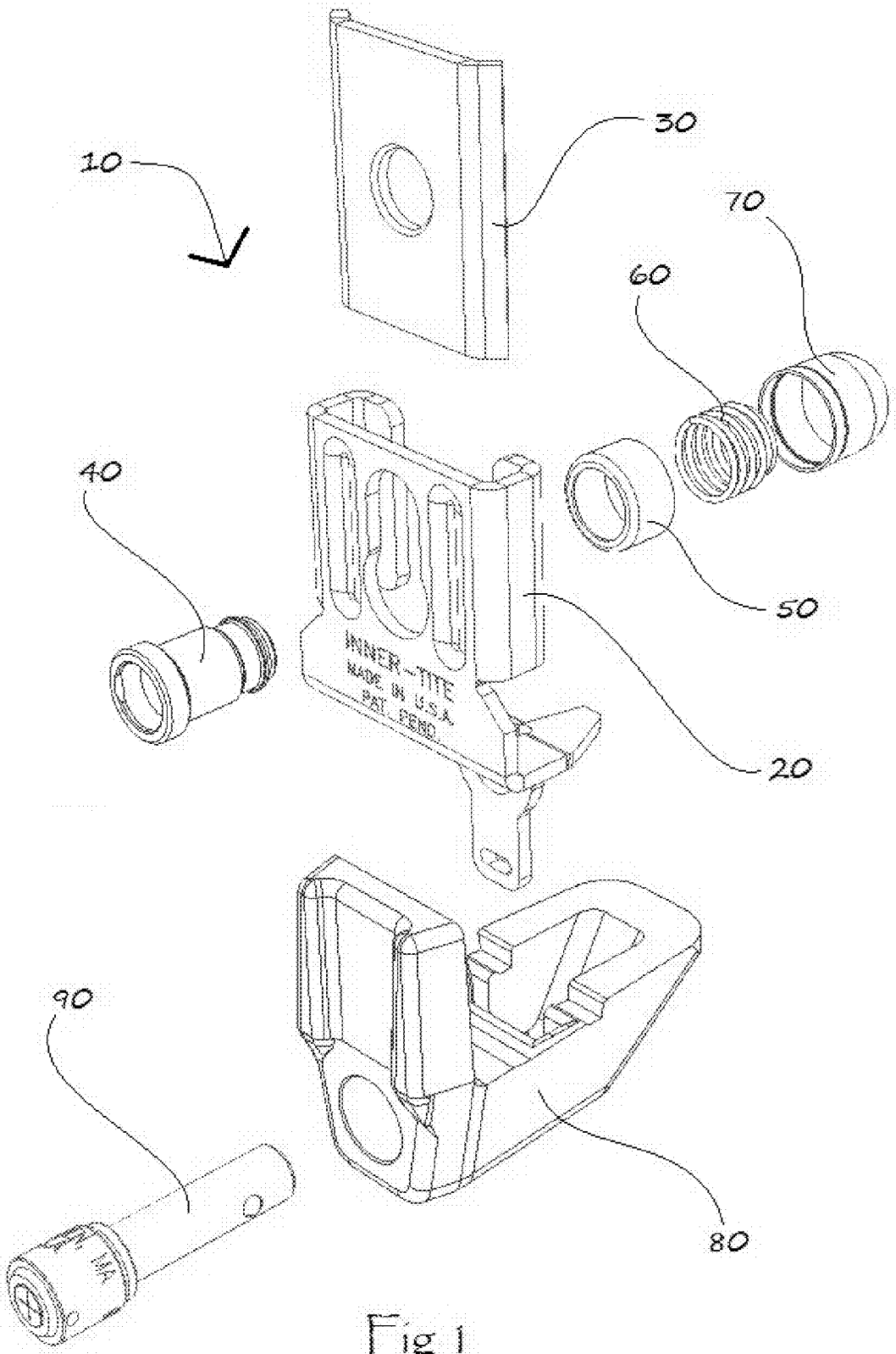
FIG. 1 is a perspective exploded view of a locking mechanism in accordance with one embodiment of the present invention.

Reference will be made below in detail to exemplary embodiments of the invention, examples of which are illustrated in the accompanying drawings. Wherever possible, the same reference numerals used throughout the drawings refer to the same or like components. As used herein, the terms "substantially," "generally," and "about" indicate conditions within reasonably achievable manufacturing/assembly tolerances and test measurements. While an embodiment of the inventive locking mechanism is described as for use in securing electric utility boxes, meter boxes or similarly constructed boxes, which are referred to herein as "securable boxes," embodiments may be configured for securing other types of structures. Moreover, embodiments of the present invention may be mounted on various surfaces of a securable box or like structure including top, side and bottom surfaces of differently constructed structures.

Referring to FIG. 1, an embodiment of the inventive locking mechanism 10 includes a bracket 20, an insert/blade 30, a pin 40, a cup 50, a spring 60 and a cap 70 that protects the pin from tampering. The locking mechanism 10 further includes a body portion 80 and a barrel lock 90.

Figure 2:
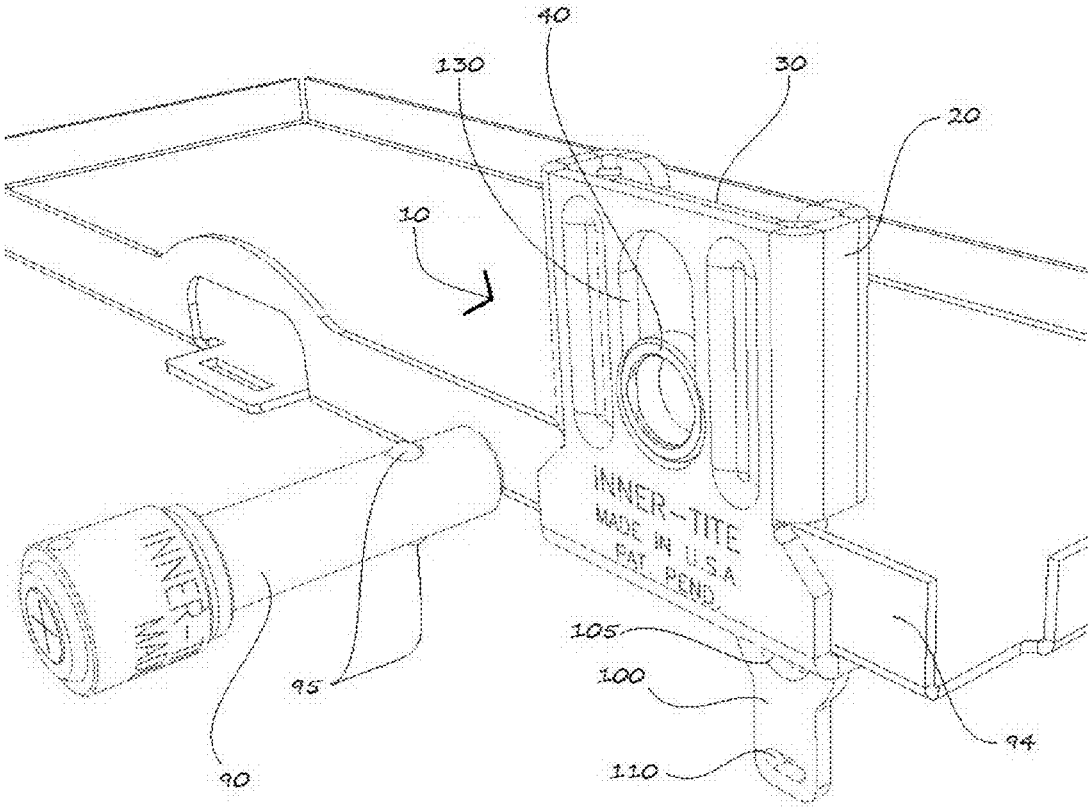
FIG. 2 is a front perspective view of the embodiment of FIG. 1 mounted on a bottom wall of a meter box.
Figure 3:
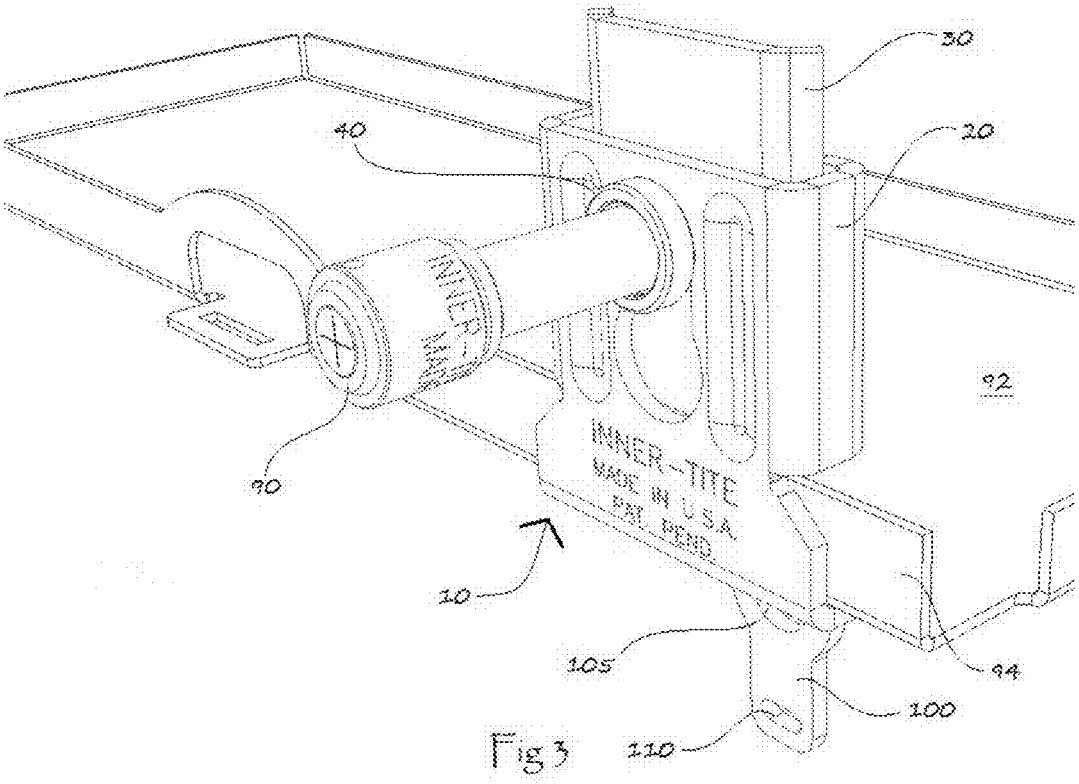
FIG. 3 is another front perspective view of the embodiment of FIG. 1 mounted on a bottom wall of a meter box.

Referring now to FIGS. 2 and 3, installation of the mechanism 10 is performed by removing an outer cover of a securable box (not shown), placing the lock mechanism 10 onto the bottom edge 94 of the securable box and moving the insert 30 into the secured position in one smooth motion using, for example, a utility worker's thumb. More specifically, the locking mechanism 10 has been designed to be functional in securing the locking device onto a securable box with ease, in the case where a utility workers grasping ability may be reduced or smaller than other utility workers. The design of the locking mechanism 10 installation was intended to be a single-handed operation for speed and simplicity.

One embodiment of the design of the locking mechanism 10 also eliminates the need for a utility worker to reach into a live box to install and remove the locking mechanism 10. All activating and removal features of the current embodiment of the locking mechanism 10 are facing outward from the securable box. Activating motions are not inward toward the live terminals. Removal of the locking mechanism 10 requires the pin 40 to be retracted outward and slid upward to the upper side of the keyhole slot 130 of the bracket 20. Once the pin 40 has been placed into that position, the locking device 10 is now able to be removed by pulling the device 10 outward toward the utility worker and away from the interior of the securable box 500 and possible live terminals.

Continuing to refer to FIGS. 2 and 3, in one embodiment, removal of the locking mechanism 10 is performed with an unactuated (locking balls exposed) industry standard barrel lock 90 by lining up the locking balls 95 with the indicating marks 310 on one embodiment of the pin 40. Inserting the barrel lock 90 into the pin 40 fully, rotating the barrel lock 90 so that the balls 95 rotate past the ball grooves 300 to engage the locking balls into the ball groove 280, and pulling the pin 40 outward and lifting upward to the top of the keyhole slot 130 in the bracket 20 in one smooth motion. This action releases the insert 30 from engaging the securable box 92, allowing the current embodiment of the locking device to be removed.

In certain embodiments, the locking mechanism may be removed using implements other than an unactuated barrel lock. For example, in some embodiments, removal may be accomplished through the use of a thumbnail or similar tool.

Figure 4:
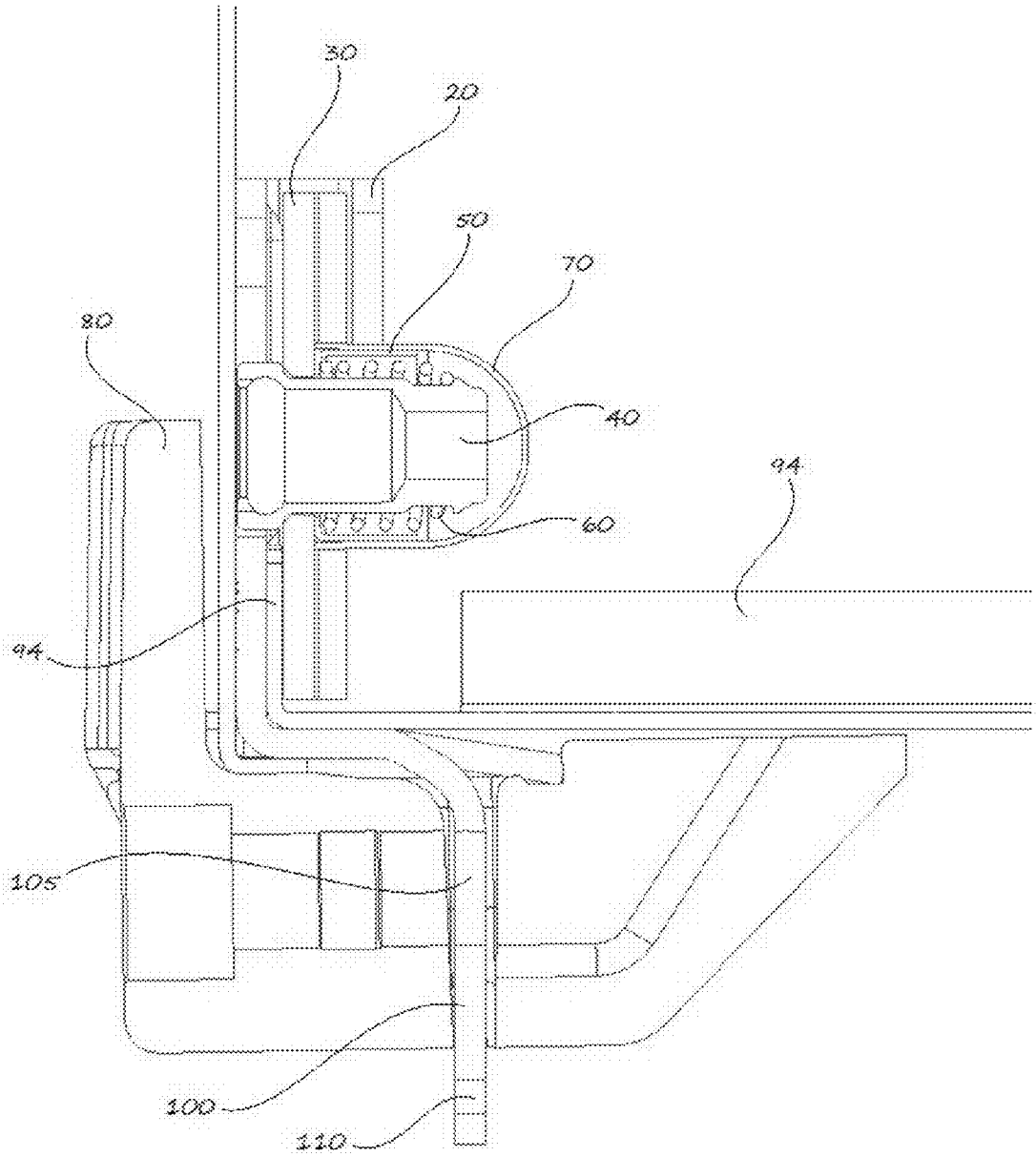
FIG. 4 is a cutaway side view of the locking mechanism of FIG. 1 secured to a meter box.

Referring to FIG. 4, in certain embodiments of the invention, a tamper resistance/security mechanism is included. In such embodiments, tampering attempts are reduced with the protection of the pin 40 from being activated by external means with the use of the cap 70. The cap 70 is pressed onto the cup 50 enclosing the spring 60 and the pin 40. The spring 60 urges the cup 50 against the insert 30 when the spring 60 is installed onto the pin. Pulling on the cap 70 results in compression of the spring 60 but not the activation of the pin 40 as the direction of force applied is the same direction used to keep the pin 40 in the locked position. The semi-spherical shape of the cap 70 reduces the ability of crushing the cap 70 to activate the pin 40 from side or rear access points. As will be appreciated, however, other cap shapes may be employed. Additional protection from external attempts of tampering with the locking device is provided by the body 80, which extends beyond the center of the pin 40 and prevents it from being activated into the releasing position without evidence of tampering.

Figure 5:
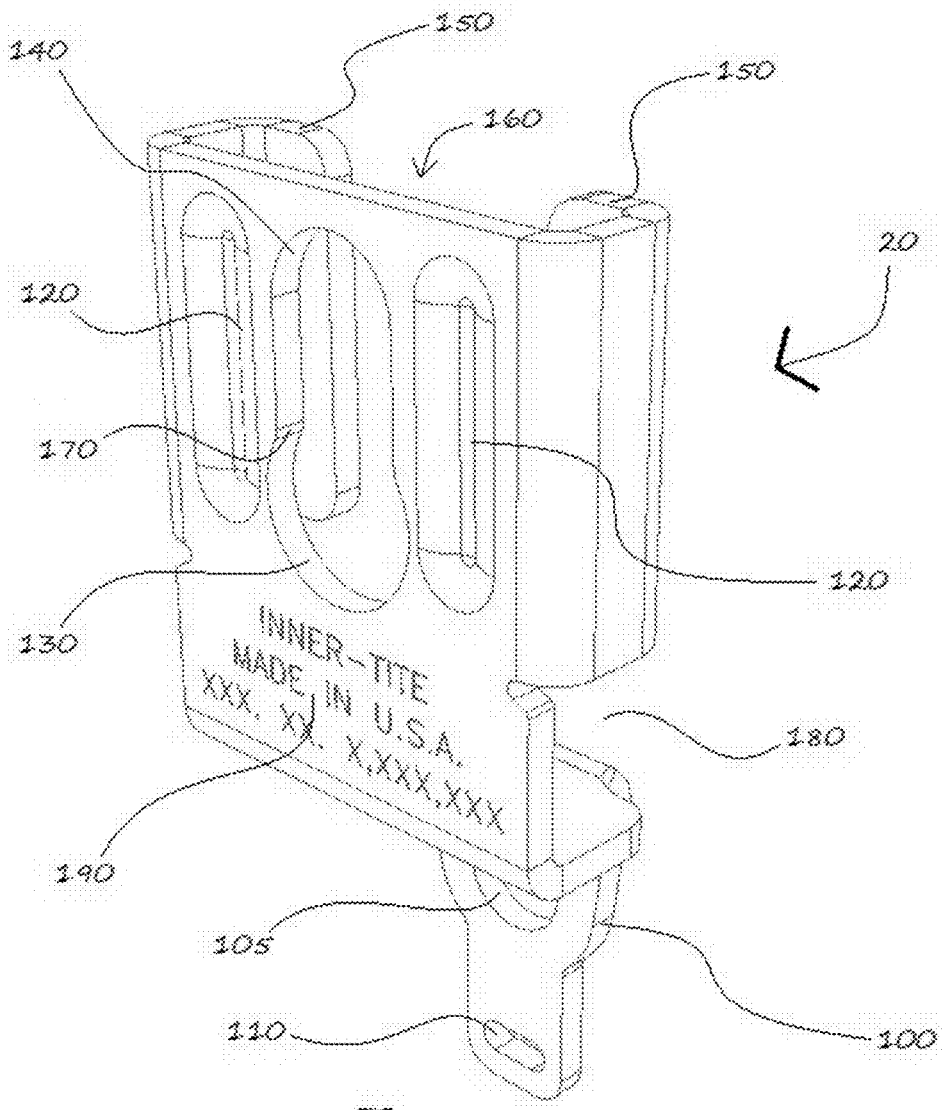
FIG. 5 is a perspective view of one embodiment of a bracket from the locking mechanism of FIG. 1.

Referring generally to FIGS. 5-10, the components of an embodiment of the locking mechanism 10 are shown in greater detail. As depicted in FIG. 5, the bracket 20 includes ribs 120 that provide the spacing needed for the insert 30 to capture the bottom flange of the electric utility box 92. The bracket 20 further includes a keyhole slot 130 that retains the pin 40 in the locked position (FIG. 2) and provides an area 140 for the pin 40 to slide into when it's placed into the unlocked and released position (FIG. 3). The slot 130 also includes a radiused or rounded transition portion 170, which allows the pin 40 to transition from the unlocked to the locked position smoothly. The locking tab 100 includes a slot 110 to install a secondary sealing device once the body 80 has been installed and secured with an industry standard barrel lock 90. The bracket 20 locking tab 100 also includes an aperture 105 to accept an industry standard barrel lock 90 when the body 80 is installed onto the locking device 10 once the locking device 10 is installed onto or into a utility box 500.

The bracket 20 further includes wing portions 150 that create a substantially C-shaped bracket interior 160, which works in conjunction with the insert/blade 30 during activation and locking. In particular, the blade 30 is movable relative to the bracket 20. In one embodiment, the blade 30 is situated within the bracket 20 and is mobile. In other embodiments, specific functions of the components may be reversed and the bracket may be moveable with respect to the blade 30. The bracket 20 also includes a flange opening 180 that provides an area for a flange of a securable box to rest when the device is installed and in use. The bracket 20 may optionally include a text space 190 which provides an area for the means of product identification.

Figure 6:
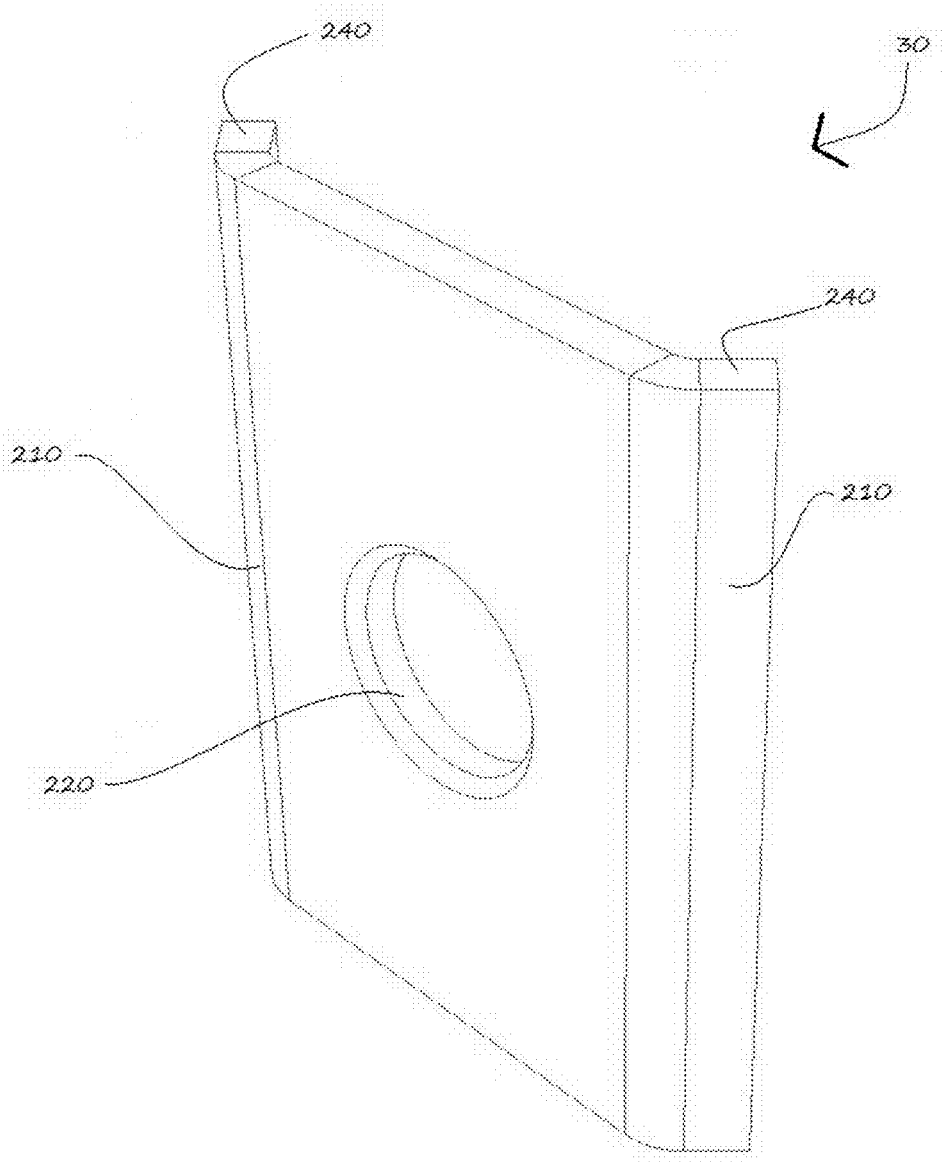
FIG. 6 is a perspective view of one embodiment of an insert from the locking mechanism of FIG. 1.

Referring now to FIG. 6, the insert 30 includes bent side flanges 210 that provide strength to the insert 30 to combat removal. As shown, the insert 30 also features a pin aperture 220, which receives the pin 40 when in use.

In certain embodiments, the insert may further include filleted corners 240 which provide a rounded edge so installation utility workers are protected against cuts or abrasions.

Figure 7A:
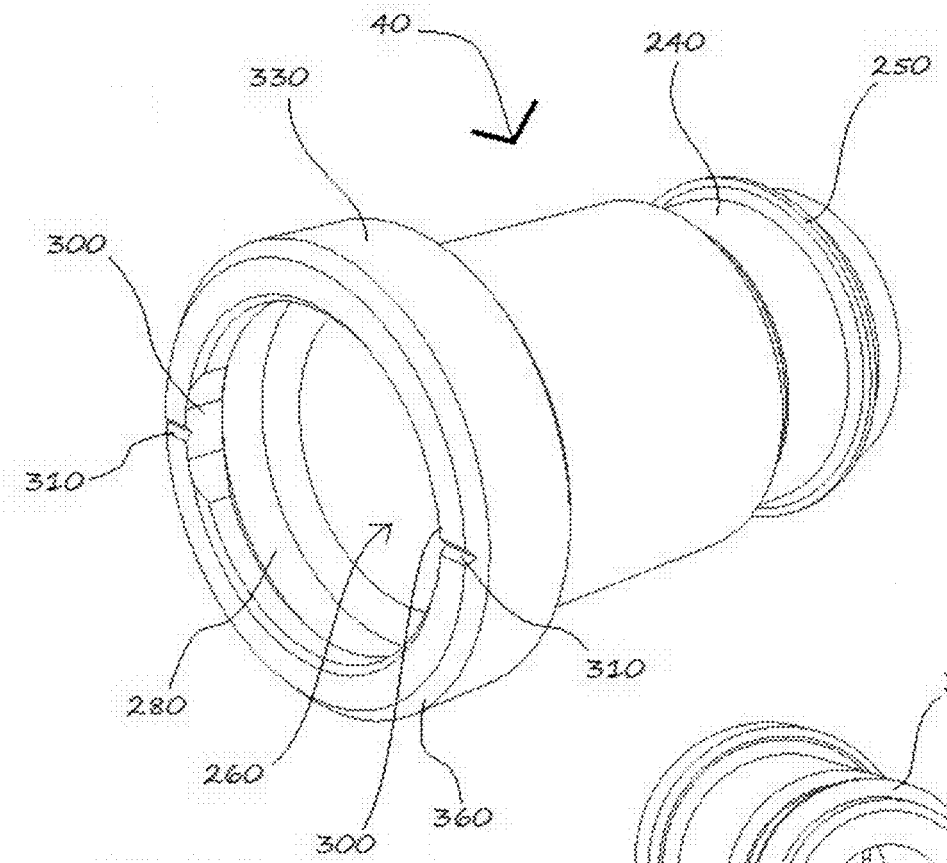
FIGS. 7A and 7B are front and rear perspective views, respectively, of one embodiment of a pin from the locking mechanism of FIG. 1.

Turning now to FIG. 7A, this embodiment of the pin 40 features a spring groove 240, which captures the spring 60 without additional fasteners, securing devices or parts. The spring groove 240 includes a bearing face 250 which is configured to be beyond the center of the spring wire, providing a bearing surface for the spring 60 to grasp onto. At the opposition end of the pin 40, a head flange 330 having an increased diameter provides a bearing surface for the pin 40 against the bracket 20 once the lock is installed and activated. The head flange 330 has a chamfered surface 360 so that there is no sharp outer edge that could cut a worker during installation.

The pin has an interior 260 configured to provide ample space for an industry standard barrel lock 90. The pin 40 further includes an annular ball groove 280 that provides an unlocking means for the device. Ball reliefs 300 transition into the ball groove 280 thereby facilitating the insertion of an industry standard barrel lock 90. In one embodiment, the pin 40 includes indicating marks 310 that provide a visual means of lining up the locking balls 95 of an industry standard barrel lock 90 into the ball reliefs 300.

Figure 7B:
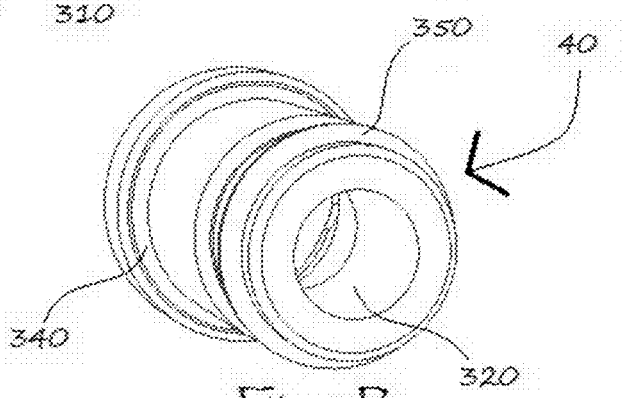

As shown in FIG. 7B, the pin 40 includes a through hole 320 that provides a means of draining plating material during the plating process. The pin 40 also has a fillet radius portion 340 that reduces the friction against the bracket 20 upon lock installation and activation. An angled lead-in surface 350 provides a ramp to aid in the installation of the spring 60 during assembly.

Figure 8:
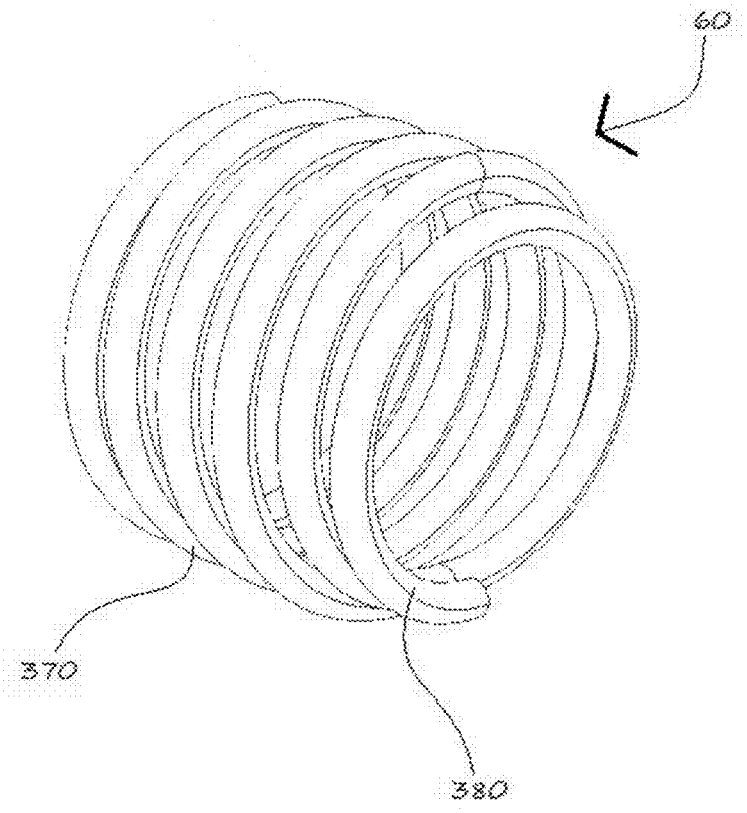
FIG. 8 is a perspective view of one embodiment of a spring from the locking mechanism of FIG. 1.

The spring 60 is depicted in FIG. 8 and includes a first end having a spring diameter 370 configured to slide over the pin 40 for smooth operation. A second spring end having a reduced diameter 380 is designed to have a very secure grasp of the pin 40 in the spring groove 240 and bearing face 250.

Figure 9:
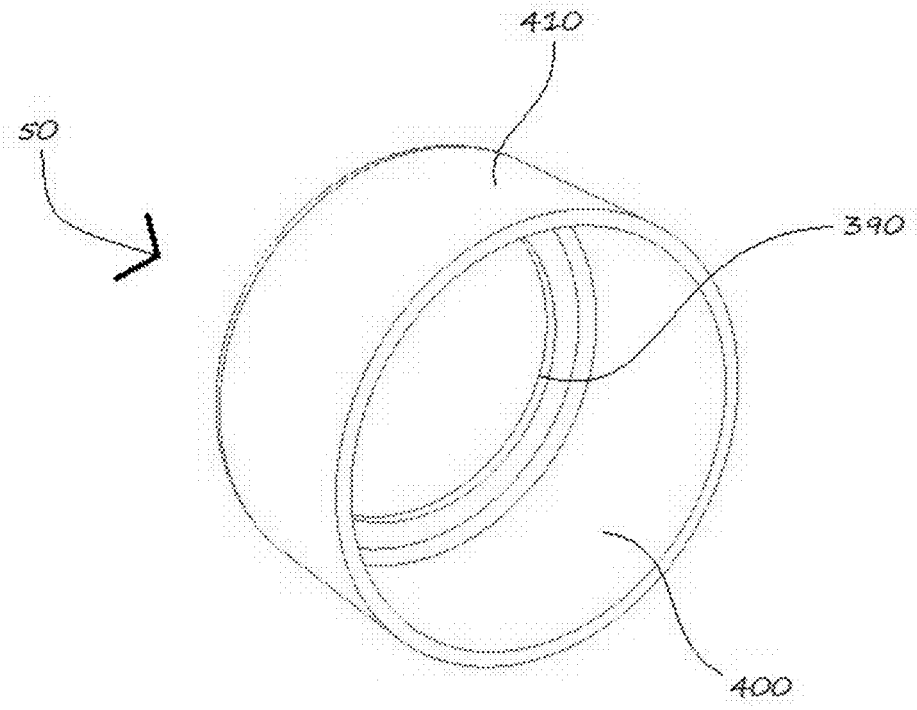
FIG. 9 is a perspective view of one embodiment of a cup from the locking mechanism of FIG. 1.

Referring now to FIG. 9, the cup 50 includes an aperture 390 having a diameter with clearance for the pin 40. The cup 50 has an inside diameter 400 that provides sufficient clearance for compression of the spring 60 upon lock storage and removal procedures. The cup outside diameter 410 is tightly controlled to provide an interference press fit with the cap 70. As will be appreciated, the cup 50 should be sufficiently thick to allow the spring 60 to be compressed enough, even at installation, to prevent rattles that are present in loose assemblies.

Figure 10:
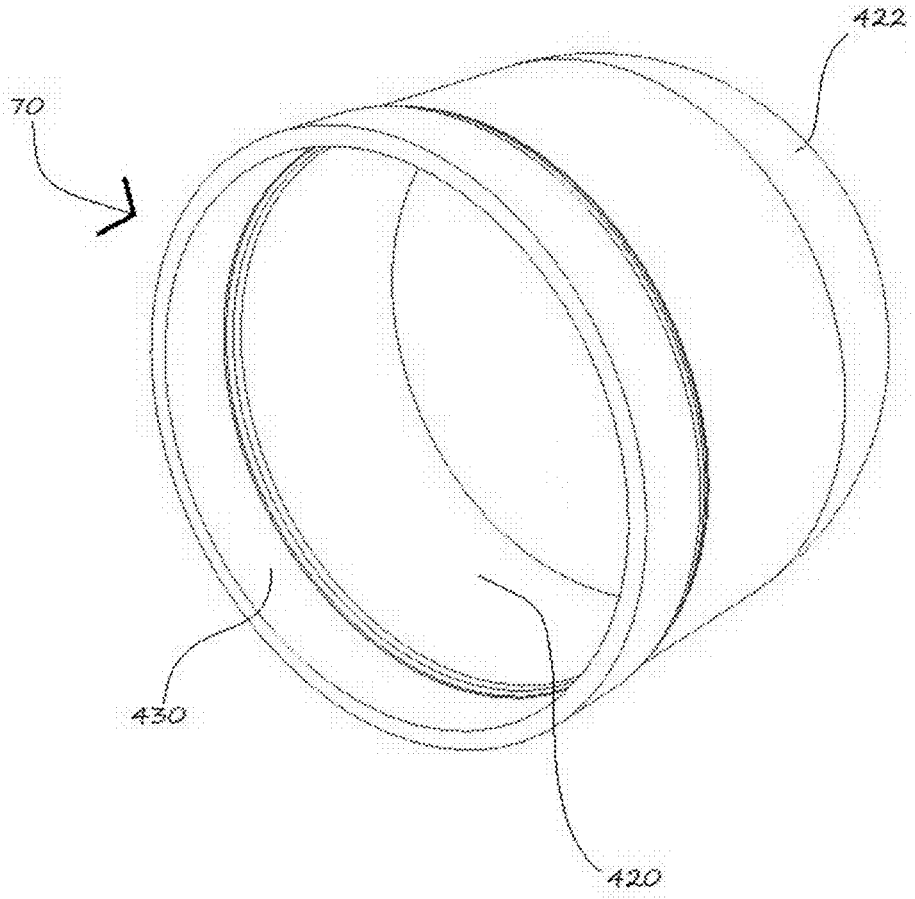
FIG. 10 is a perspective view of one embodiment of a cap from the locking mechanism of FIG. 1.

Referring now to FIG. 10, the cap 70 has an inside diameter 420 that is tightly controlled to provide an interference press fit with the cup 50. The semi-spherical end portion 422 of the cap 70 is designed to prevent tampering attempts with tools as no flat face is provided to pry against, crush or penetrate easily. A lead-in portion 430 is provided to aid in the assembly of the cap 70 to the cup 50 by allowing the cap 70 and cup 50 to self-align during assembly.

Figure 11:
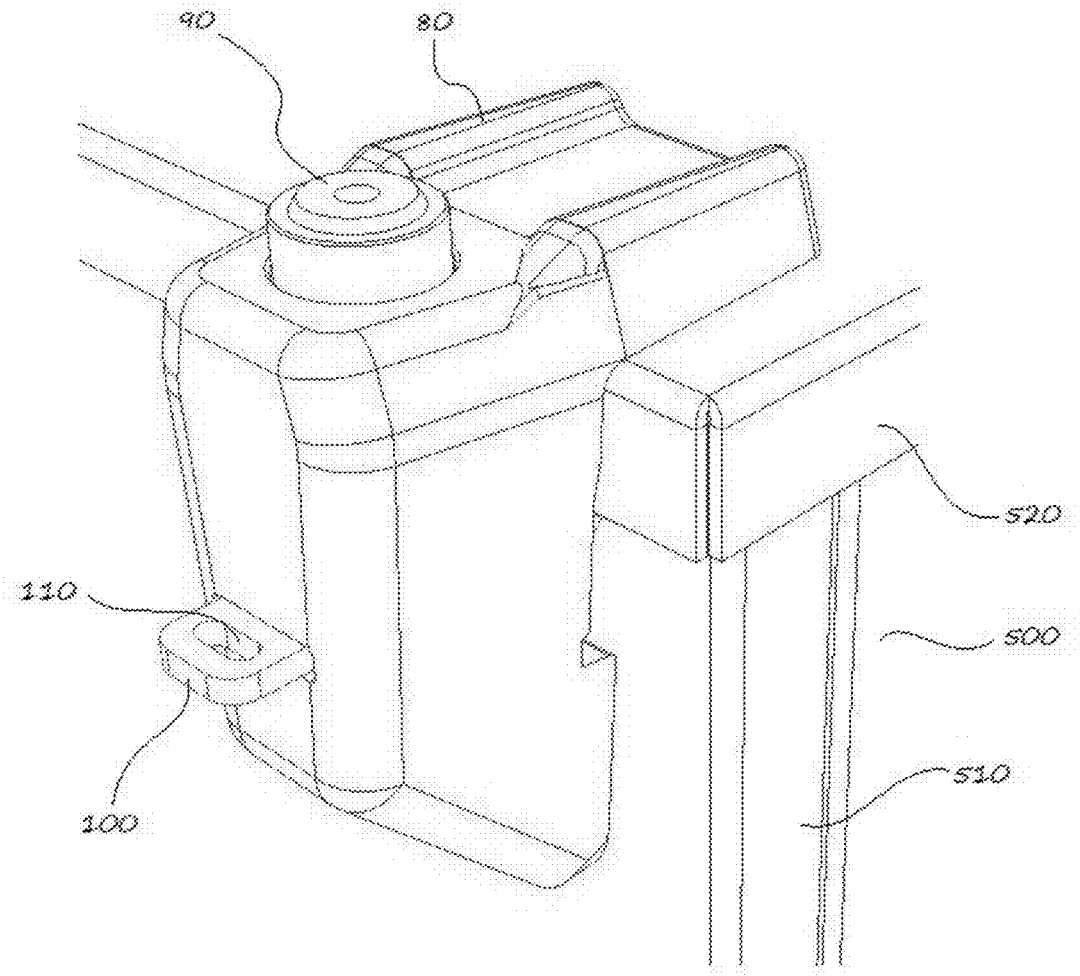
FIG. 11 is a perspective view of one embodiment of the locking mechanism of FIG. 1 mounted on a top surface of a meter box.
Figure 12:
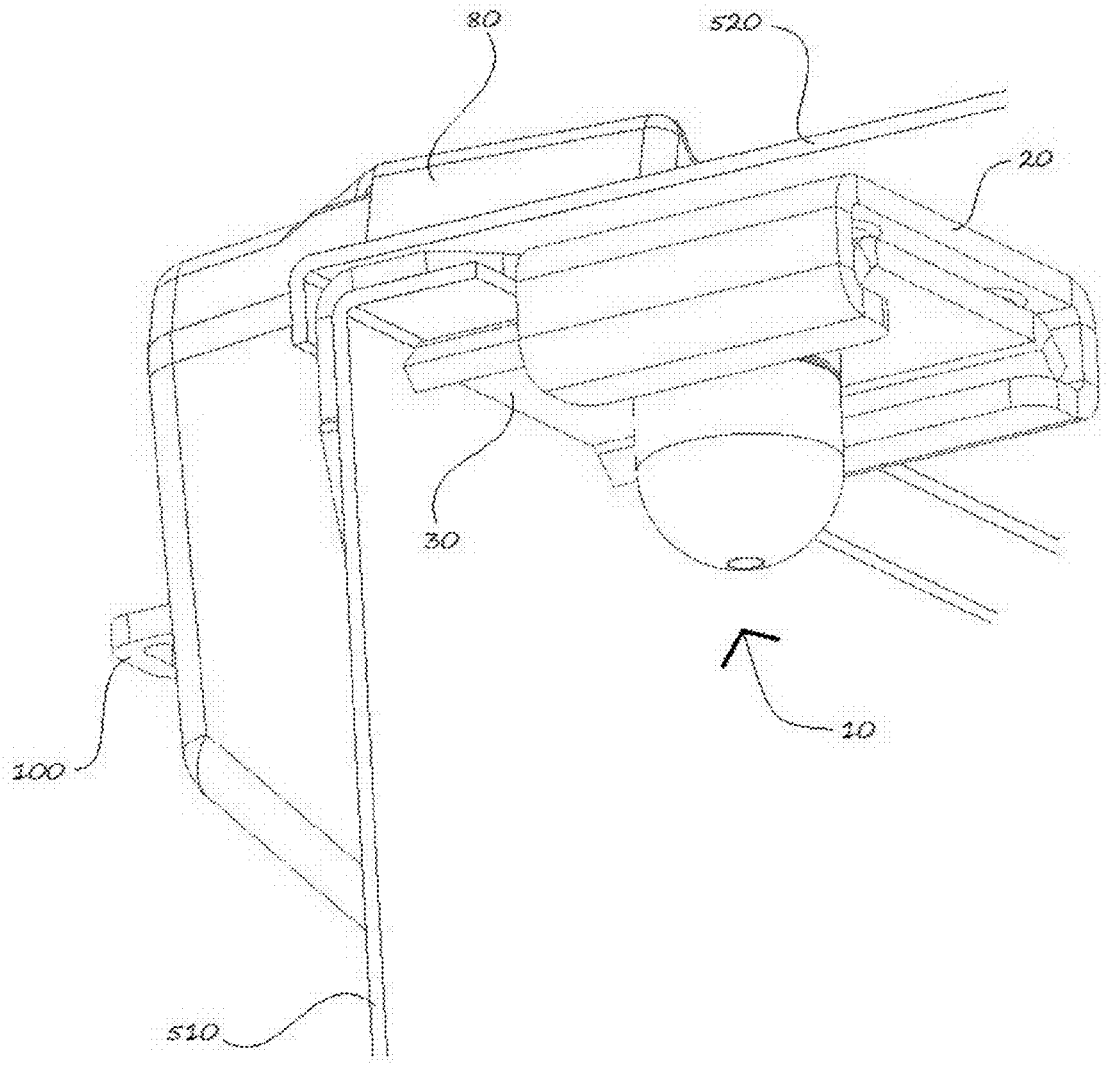
FIG. 12 is a cutaway perspective view of one embodiment of the mounting configuration of FIG. 11.
Figure 13:
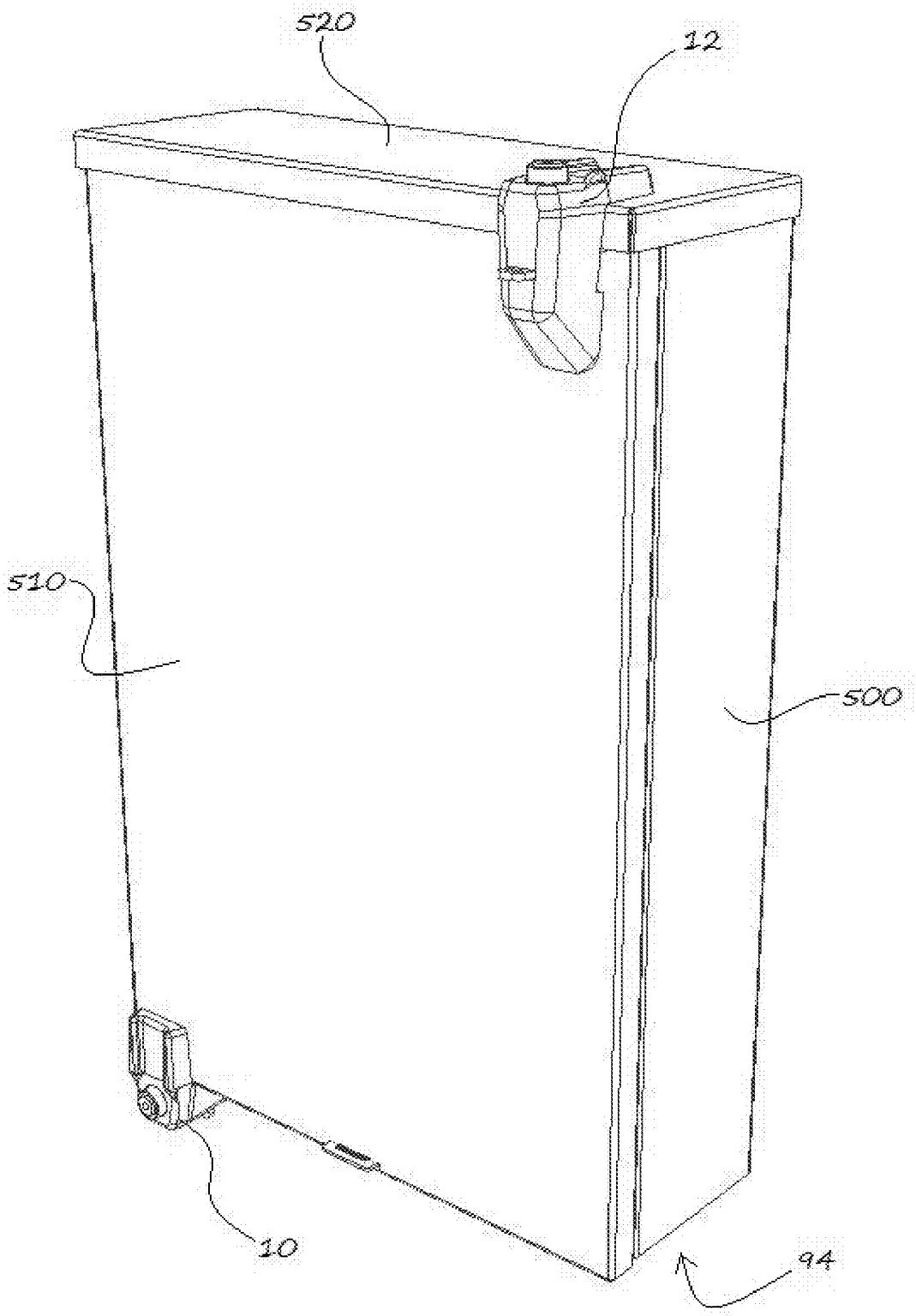
FIG. 13 is a perspective view of a meter box having one embodiment of the locking mechanisms of FIG. 1 mounted on top and bottom meter box surfaces.

Referring now to FIGS. 11-13, the locking mechanism 10 can be installed in alternate locations on securable boxes. In FIG. 13, locking mechanisms 10, 12 are shown mounted on top and bottom surfaces of a securable box 500. FIG. 12 provides greater detail showing the locking device 10 mounted onto the top of the cover 510. The device 10 may be installed regardless of whether the cover has a top flange or not. Once the lock mechanism 10 is installed, the cover 510 is installed normally and the body 80 is installed over the locking tab 100 and the barrel lock 90 is pushed into place. The insert 30 secures the locking mechanism 10 onto the cover 510 flange to prevent the top 520 of the securable box from being pried upward to remove the cover from the top edge.

The above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," "third," "upper," "lower," "bottom," "top," etc. are used merely as labels, and are not intended to impose numerical or positional requirements on their objects.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A locking mechanism comprising:

a bracket configured for mounting on a wall of a securable box, the bracket including a slot;

a lock body received by the bracket to selectively secure a cover to the securable box preventing access to an interior of the box;

a blade that is movable relative to the bracket between a locked position and an unlocked position to secure or remove the blade and bracket to or from a securable box wall respectively; and a pin configured to extend through the slot and into an aperture in the blade;

wherein the slot in the bracket defines a path of travel of the blade relative to the bracket between the locked and unlocked positions; and wherein the pin may travel within the slot to place the blade in the locked or unlocked position.

2. The locking mechanism of claim 1 wherein the pin is biased within the slot such that when mounted on the wall of a securable box the blade is held in the locked position.

3. The locking mechanism of claim 2 wherein the pin is secured to the blade and bracket through the use of a spring contained within a cup.

4. The locking mechanism of claim 3 wherein the pin and cup are covered by a cap to prevent tampering.

5. The locking mechanism of claim 1 wherein the slot in the bracket has a first portion having a first width and a second portion having a second width which is greater than the first width; and wherein the pin is in the first portion when the blade is unlocked and in the second portion when the blade is locked.

6. The locking mechanism of claim 1 wherein the blade is configured to be moved relative to the bracket between a locked position and an unlocked position using a removal tool.

7. The locking mechanism of claim 6 wherein the removal tool is a barrel lock.

8. The locking mechanism of claim 1 wherein the bracket includes a locking tab that has an aperture configured to receive a barrel lock allowing a lock body to be secured to the locking mechanism via the locking tab thereby securing the cover to the securable box.

9. A lock assembly comprising:

a lock body configured to receive a lock;

a bracket configured for mounting on a wall of a securable box and receiving the lock body and lock to selectively secure a cover to the securable box preventing access to an interior of the box;

a blade that is movable relative to the bracket between a locked position and an unlocked position to secure or remove the blade and bracket to or from a securable box wall respectively;

a pin that is received in and travels in a slot in the bracket to move the blade between the locked and unlocked positions.

10. The lock assembly of claim 9 wherein the lock is a barrel lock.

11. The lock assembly of claim 10 wherein the pin is configured to receive a removal tool allowing the blade to be moved between the locked and unlocked positions.

12. The lock assembly of claim 11 wherein the removal tool is a barrel lock.

13. A method of preventing access to an interior of a securable box comprising:

placing a bracket on a wall of a securable box;

moving a blade relative to the bracket into a locked position to secure the blade and bracket to the securable box wall, including sliding a pin that is connected to the blade and housed within a slot in the bracket to move the blade from an unlocked position to a locked position thereby securing the blade and bracket to the securable box wall;

placing a cover on the securable box;

securing a lock body to the bracket.

14. The method of claim 13 wherein the step of securing the lock body to the bracket comprises:

securing a barrel lock within the lock body.

15. A method of removing a lock assembly from a securable box comprising:

removing a lock body from a bracket that is secured to a wall of a securable box;

removing a cover from the securable box;

moving a blade relative to the bracket into a unlocked position to remove blade and bracket from the securable box wall, including sliding a pin that is connected to the blade and housed within a slot in the bracket to move the blade from a locked position to an unlocked position thereby allowing the blade and bracket to be removed from the securable box wall.

16. The method of claim 15 wherein the step of removing the lock body from the bracket comprises:

removing a barrel lock from the lock body.

17. A locking mechanism comprising:

a bracket configured for mounting on a surface of a securable box and configured to receive a lock body to secure the box;

a blade that is movable relative to the bracket, the blade being movable between a secured position, in which the bracket and blade are secured to the box, and an unsecured position, allowing the bracket and blade to be removed from the surface; and a pin that is received in and travels in a slot in the bracket to move the blade between the secured position and the unsecured position.

* * * * *